United States Patent [19]

Leffel

[11] Patent Number: 5,024,179

[45] Date of Patent: Jun. 18, 1991

[54] FOLDABLE SIGNAL FLAG AND STANDARD ASSEMBLY

[76] Inventor: Harold P. Leffel, E. 1245 Crystal Bay Rd., Post Falls, Id. 83854

[21] Appl. No.: 585,301

[22] Filed: Sep. 19, 1990

Related U.S. Application Data

[63] Continuation-in-part of Ser. No. 402,829, Sep. 5, 1989, Pat. No. 4,962,720.

[51] Int. Cl.[5] ..... G09F 17/00

[52] U.S. Cl. ..... 116/173; 116/28 R

[58] Field of Search ..... 116/28 R, 173, 174; 343/709, 713, 714, 720, 721, 894, 901, 903; 340/472; 40/591, 592, 601, 610

[56] References Cited

U.S. PATENT DOCUMENTS

| | | | |
|---|---|---|---|
| 2,324,614 | 7/1943 | Dalton | 116/173 |
| 2,420,772 | 5/1947 | Dalton | 343/903 |
| 3,105,459 | 10/1963 | Conn | 116/173 |
| 3,127,869 | 4/1964 | Howland | 116/173 |
| 3,602,188 | 8/1971 | Penaflor | 116/324 |
| 3,735,724 | 5/1973 | Miller | 116/303 |
| 3,786,778 | 1/1974 | Palmer et al. | 116/313 |
| 4,028,827 | 6/1977 | Hufton | 116/173 |
| 4,122,796 | 10/1978 | Pressler et al. | 116/173 |
| 4,545,320 | 10/1985 | Lewis et al. | 116/28 R |
| 4,603,333 | 7/1986 | Carlson | 343/709 |
| 4,640,213 | 2/1987 | Lugo | 114/253 |
| 4,934,972 | 6/1990 | Shumway et al. | 441/69 |
| 4,962,720 | 10/1990 | Leffel | 116/173 |

FOREIGN PATENT DOCUMENTS

| | | | |
|---|---|---|---|
| 658022 | 4/1965 | Belgium | 343/903 |

*Primary Examiner*—William A. Cuchlinski, Jr.
*Assistant Examiner*—W. Morris Worth
*Attorney, Agent, or Firm*—Wells, St. John & Roberts

[57] ABSTRACT

A self-storing flag and flag assembly is described for sub-surface mounting to a support surface. The assembly will facilitate extension of a telescoping flag standard from a below surface stowed position to an upright extended operative position, displaying a flag body. The flag assembly is also retractable to a shortened inoperative position within a sleeve below the support surface. The standard is formed of interfitting telescoping sections that are loosely received within an axial tubular connector member releasably mounted at the top end of the standard. The flag includes a lanyard mounted at one end to the flag body and at a remaining end to a spring clip attached to the top section of the telescoping standard sections. The clip pulls the lanyard into the connector member as the standard is retracted, and thereby gathers the bottom edge of the flag to the connector to minimize the vertical flag dimension to be received within the sleeve. An interruptible power drive may be provided in the assembly to selectively drive the standard and flag between the extended and stored positions. A right angle adapter is used to mount the power drive to the standard to minimize the overall height of the assembly.

18 Claims, 6 Drawing Sheets

FOLDABLE SIGNAL FLAG AND STANDARD ASSEMBLY

RELATED APPLICATIONS

The present application is a continuation-in-part application of copending U.S. Pat. application Ser. No. 402,829, filed on Sept. 5, 1989 and titled MARINE SIGNAL FLAG, now U.S. Pat. No. 4,962,720.

TECHNICAL FIELD

The present invention relates to self folding signal flags for retractable telescoping standards.

BACKGROUND OF THE INVENTION

The increased popularity of recreational boating has also increased the popularity of certain water sports such as water skiing in which an individual is pulled at the end of a tow rope at relatively high speeds behind a boat. Such sports as water skiing involve certain hazards, particularly when the participant either falls or lets loose of the tow rope. The individual becomes visually disconnected with the towing vessel and, sinking into water, becomes increasingly less visible to other boaters in the area.

In recognition of this problem, many states specify certain safety precautions. Firstly, the individuals operating the boat are required to quickly return to a downed skier. At the same time, it is advisable and often required that a signal be displayed. The signal identifies the situation that an individual or individuals are in the water in the vicinity of the boat.

Saftey-conscious boaters will carry a signal flag at the end of a fixed standard. When a water sport participant falls or lets go of the tow rope, an individual "spotter" in the boat will immediately elevate the flag and alert the operator of the boat to return immediately to the downed individual. The difficulty that has been experienced, however, is that regardless of safety consciousness, flags are misplaced and eventually become unused. This is also due in part to the fact that the "spotter" is often unwilling or unable to hold a signal flag aloft for extended periods of time, especially in a boat that is making a quick turn and a fast return to the downed individual. It is also difficult for the "spotter" to hold the flag aloft while performing other duties such as retrieving the tow rope or skis, etc. dropped by the individual in the water.

The above problem is addressed specifically in the above referenced copending patent application, in which a flag and support assembly is disclosed with a retractable standard and a self storing flag assembly. The standard and flag are retractable into a storage tube structure that may be selectively shifted between extended operative, and retracted storage conditions. In the display condition, the flag is exposed at the top end of the standard above the deck of the boat or other support surface. In the retracted condition, the flag is situated in a self storing condition, concealed within a tubular member of a support assembly.

While the device disclosed in the pending application functions well, it remains desirable to minimize the overall length dimensions for the entire apparatus, especially if the device is to be placed in confined quarters, such as within a recreational "runabout" boat hull of the type typically used for water skiing and similar sports.

U.S. Pat. No. 3,127,869 discloses a flag support sheath that recieves a signal flag for the purposes of supporting the flag at the end of a retractable mast such as an automobile radio antenna. The sheath is formed as a tubular structure with a closed top end that fits over the top of the antenna. The support includes a recess within the closed top end is shaped to receive the ball of an automotive radio antenna. The flag attaches to a slot provided in the support. The sheath is not intended to be recieved in a receptacle for the antenna, nor are any provisions shown or suggested that would facilitate folding or gathering the flag for storage in a confined area.

U.S. Pat. No. 4,028,827 discloses a sign in which a flag with a folded loop at one edge is mounted over a retractable standard having a ball or similar fitting at an outward end. The loop is slidably recieved over a length of the standard. No provision is made for recessed storage of the standard or the flag.

U.S. Pat. No. 3,602,188 discloses a ski boat warning apparatus. This device includes a flag system that will automatically operate upon release of a tow line to elevate a flag from a stowed condition within an upright, above deck exposed tubular enclosure. The longitudinally rigid flag standard is slidably supported within a tubular enclosure and is spring-biased toward an upward, extended position. The standard is connected to the tow rope through a pulley mechanism so the tension along the tow rope will normally pull the flag standard downwardly into the tube against resistance of the spring. Then, when the skier lets loose of the tow rope, the spring will be allowed to extend and elevate the standard.

The standard is rigid along its entire length and the tubular container for the standard is positioned above the deck surface of the tow boat. Thus, the entire assembly is exposed constantly and may become both a visual and physical obstruction.

Additionally, U.S. Pat. No. 3,602,188 discloses a flag assembly that may be removable from the rigid standard. This is done to enable the standard to be situated in the upwardly extended position when the boat is not being used to pull a skier. Thus, the standard is normally in an upwardly extended position and is retracted into the tubular storage arrangement only when a person applies tension to a tow rope behind the boat.

U.S. Pat. No. 3,786,778 discloses a signal device for water skiing which pivots on the deck of a boat. The base of an extendable standard is mounted to a deck or other exposed surface of the boat to pivot between a relatively horizontal inoperative position and an upright, operative position. The standard telescopes to facilitate upward extension of the signal flag and compact storage of the flag and standard above the amount surface of the boat.

U.S. Pat. No. 4,122,796 discloses another pivoted type signal flag used on water ski boats or the like. Again, this device mounts above a deck surface of the boat and includes a standard that pivots between a horizontal stowed position and an upright operative position.

A substantially similar arrangement to the pivoted flags discussed above is shown in U.S. Pat. No. 4,545,320 and in U.S. Pat. Nos. 3,735,724, and 4,640,213.

Of the above references, none provide a completely adequate solution to the problem of providing a reliable warning system for elevating a flag from a below surface storage condition and that requires minimal storage space below the support surface.

Another difficulty experienced by recreational boaters is a lack of an adequate antenna for radios. Many recreational boats are supplied with standard AM-FM radios. However, such vessels are very infrequently supplied with extended antennas. This is due at least in part to the fact that the owners do not wish to have the deck surface of the boat cluttered with objects that visually interfere with the typically smooth, sweeping lines of the boat hull and deck configuration. This is also due to the fact that the boats are typically extremely expensive even without "options". Optional items are usually purchased only when there is a demonstrated need. The standard radios supplied with boats operate adequately if the boating area is near a radio transmitter. Thus, antennas are normally avoided as unnecessary additional cost to an already expensive recreational "toy".

The present invention provides an excellent solution to the problems experienced by others in the design of signal flags, and to the need for radio antennas.

It is a primary object of the present invention to provide a self-storing signalling device that will stow in a subsurface, unobtrusive position such that standard when not in use will not present a physical or visual obstruction along the exposed support surface.

It is a still further objective to provide such flag arrangement in which the flag may be removed entirely and the standard be utilized as a conventional radio antenna.

It is a still further objective to provide such a device that may be automated to the extent that an operator may simply actuate a switch on a control panel to cause the flag to be elevated or withdrawn below the deck surface.

These and still further objectives and advantages will become apparent upon reading the following detailed description which, taken with the accompanying drawings, disclose preferred forms of the present invention.

BRIEF DESCRIPTION OF THE DRAWINGS

The present invention is exemplified in the accompanying drawings in which.

DETAILED DESCRIPTION OF THE PREFERRED EMBODIMENTS

Figure 1:
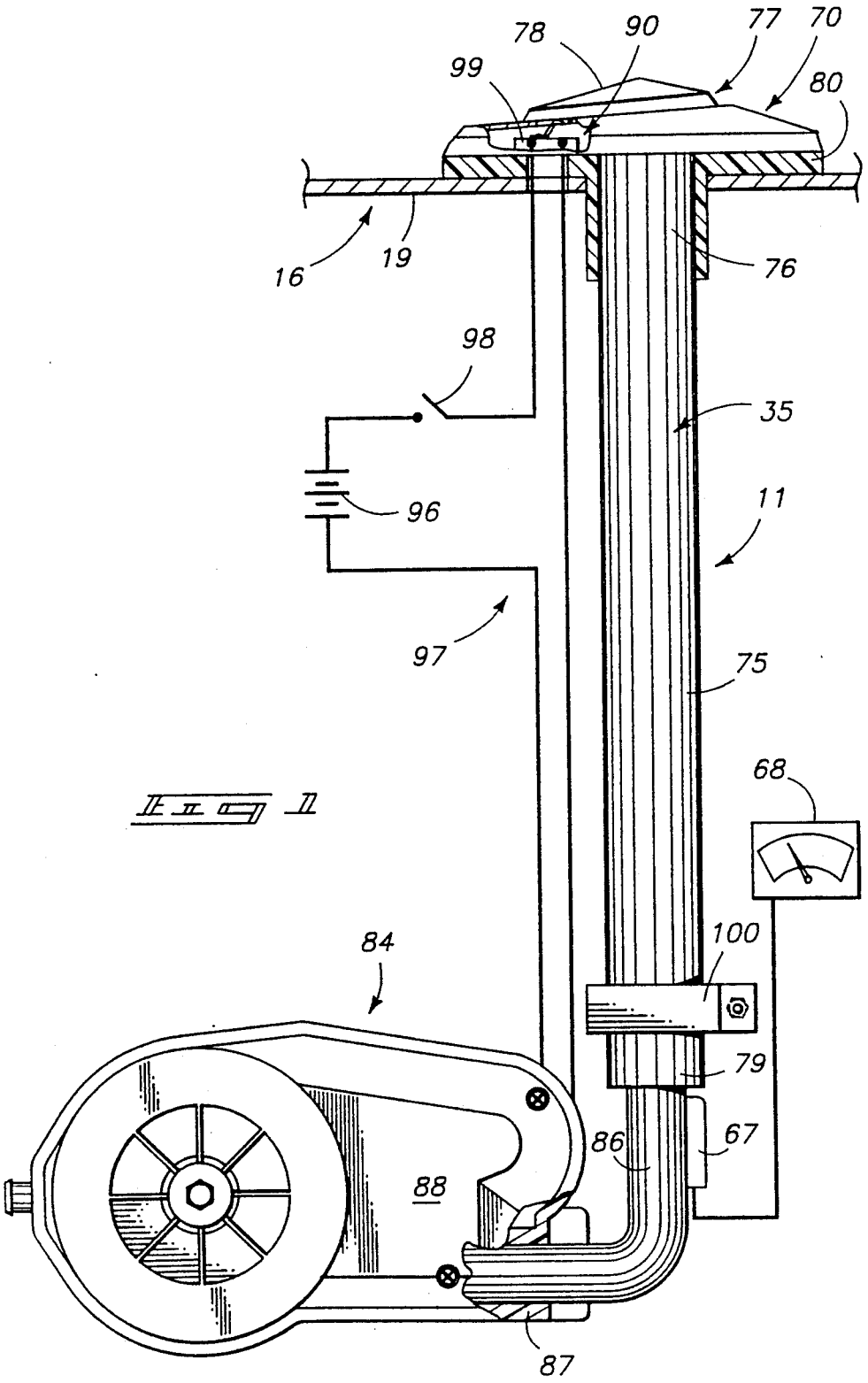
FIG. 1 is an elevational view of the present foldable signal flag and standard assembly in a retracted condition.

The following disclosure of the invention is submitted in furtherance with the constitutional purpose of the Patent Laws "to promote the progress of science and useful arts" (Article 1, Section 8).

The present invention is embodied in a flag 10 and a flag assembly 11. The assembly 11 includes the present flag 10 on a retractable telescoping standard 14, and provisions for mounting the assembly to a support surface 16.

Preferably, the support surface 16 is a deck or other upwardly facing exposed support surface having an area along an underside 19 that includes sufficient open vertical space to facilitate mounting of the assembly 11 with a major portion of the assembly length below the surface 16.

The preferred flag 10 includes a flag body 12 formed of a flexible material such as nylon or similar tough and durable yet flexible fabric. The flag body 12 may take any standard configuration such as the one foot by one foot square configuration commonly used for warning of downed water skiers. The flag might also be otherwise configured as an identification or signal flag.

Figure 3:
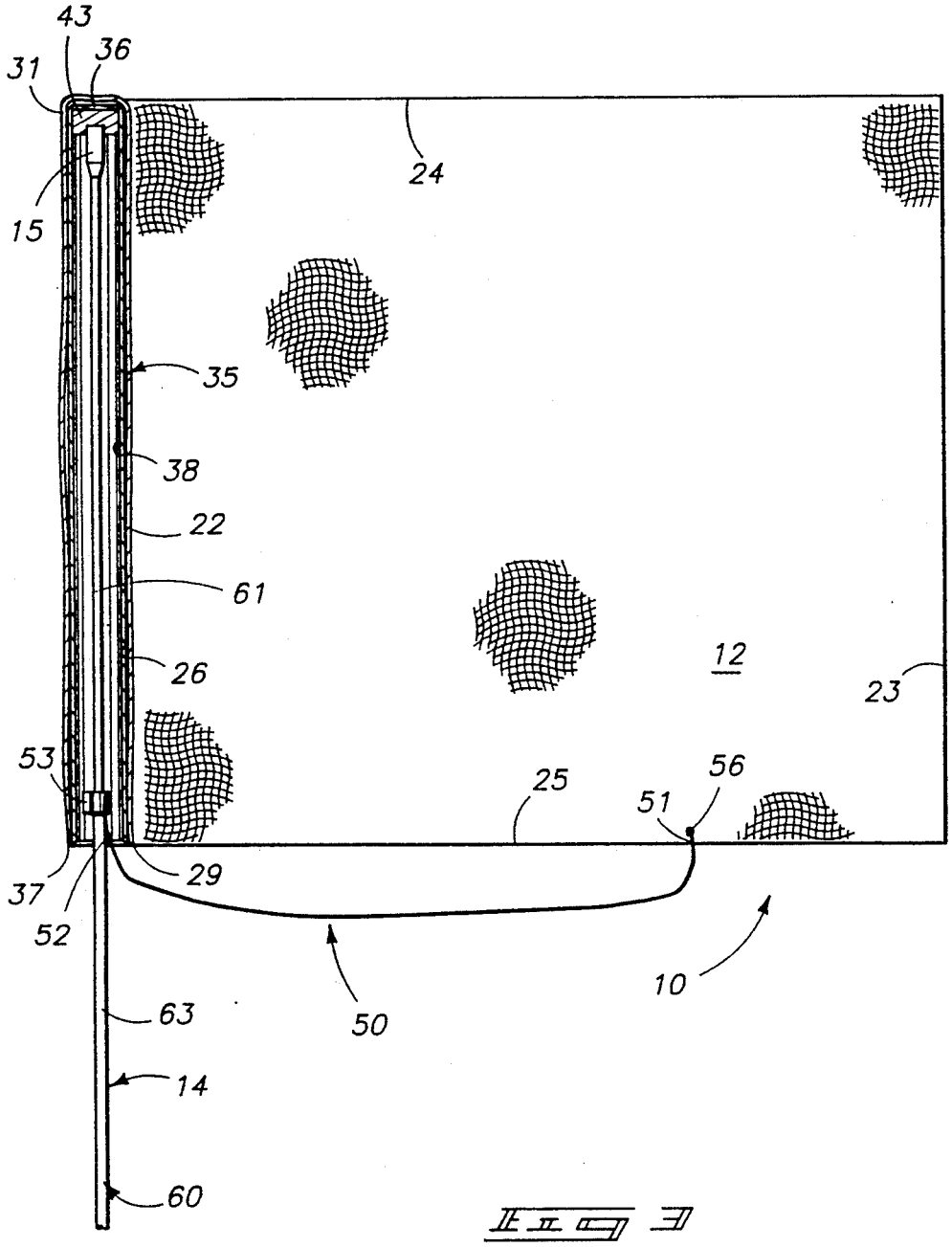
FIG. 3 is a fragmented sectional view of the present flag mounted atop a retractable standard.

The preferred flag 10 includes a leading edge 22 and a trailing edge 23. A top edge 24 and an opposed bottom edge 25 complete the preferred flag perimeter. A pocket 26 (FIGS. 3, 4, 6) may be formed at the leading edge 22 of the flag body 12 by folding an edge of the flag body onto itself and attaching the edge to the flag body. The fold may be secured across one end and along the flag body by standard fastening techinques such as sewing, adhesive, etc. The pocket 26 thus formed will extend from an open end 29 at a bottom end of the leading edge 22 to a closed end 31 at a top end of the leading edge 22.

A connector member 35 is received within the pocket 26 of the flag body. Means for securing the flag body to the connector member is provided in the form of adhesive applied between the pocket 26 and member 35, or by a mechanical connection as shown in my earlier filed application cited above.

The connector member 35 is receivable over a selected length of the retractable standard 14. Member 35 is hollow along its length, with a central bore 38 extending between the top and bottom ends 36, 37. The bore 38 is larger in cross sectional diameter than the corresponding largest diameter of the standard 14. The connector member 35 will therefore loosely receive and overlap at least a portion of the standard 14 length when the standard 14 is fully extended as shown in FIG. 1.

Figure 5:
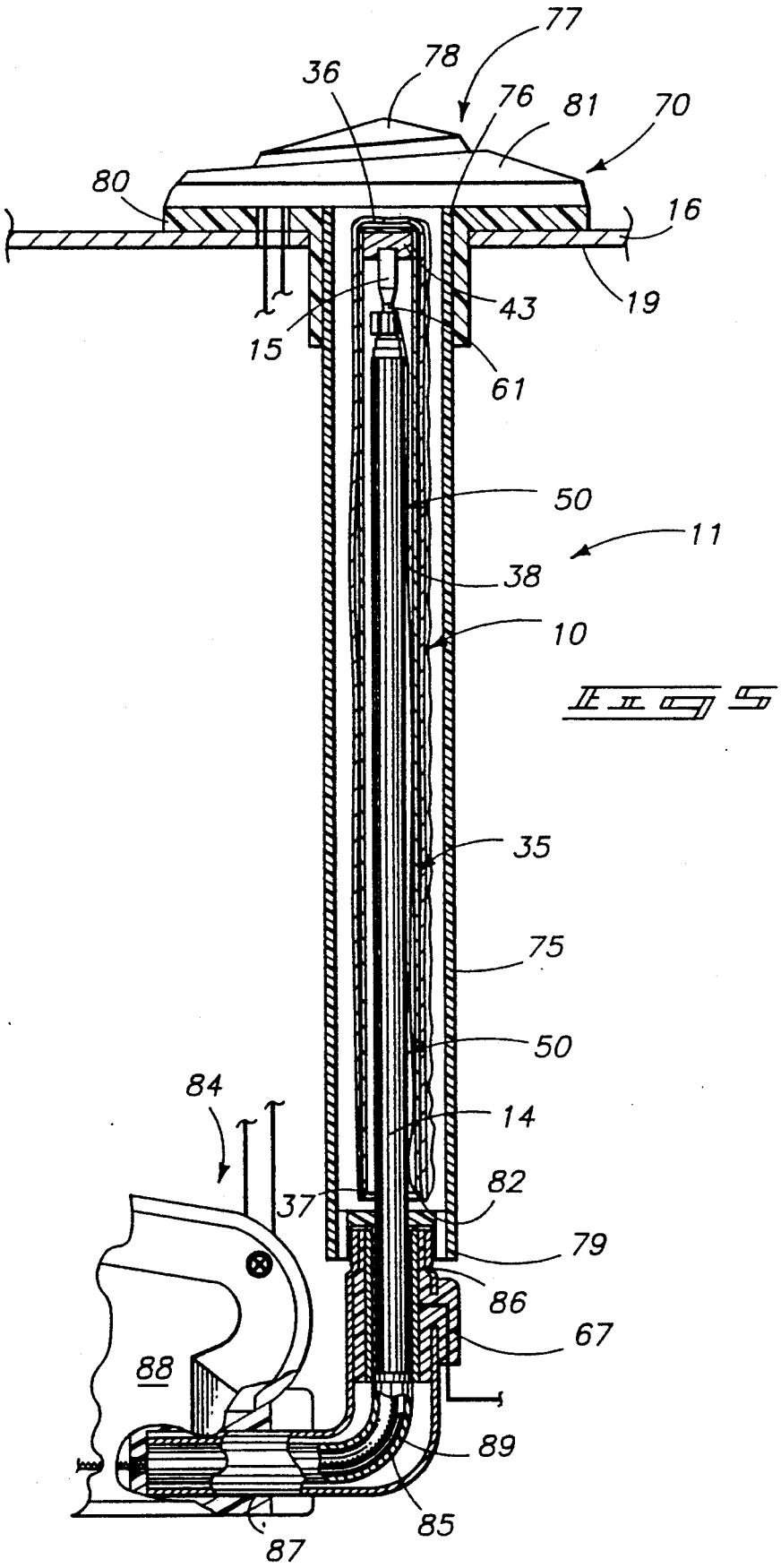
FIG. 5 is an enlarged fragmented sectional view showing details of the present flag and assembly.

The connector member 35 will also preferably overlap substantially the full retracted length of the standard (FIG. 5). This relationship facilitates full retraction of the standard 14 and storage of the flag 10 within a confined space below the support surface 16.

An attachment fitting 43 is provided on the connector member for releasably securing the connector member 35 and flag body 12 to the top end 15 of the retractable standard 14. The fitting 43 is positioned at the top end 36 of the connector member 35 so the telescoping sections of the standard may be selectively retracted at least partially and preferably substantially completely into the connector member between its top and bottom ends, 36, 37.

The present flag 10 includes a lanyard 50 (FIGS. 2–7) mounted at a first end 51 to the flag body 12. In the preferred form, the lanyard end 51 is tied or is otherwise attached to the flag body adjacent its bottom edge 25.

The location for the lanyard attachment point 56 on the flag is at least approximately three fourths of the distance from the leading edge 22 to the trailing edge 23. The lanyard length is also approximately equal to the length of the connector member 35. This relationship is important to the function of the lanyard 50 in furling the flag body 12 as the standard 14 is retracted to facilitate storage of the flag in a minimal vertical space (FIG. 5).

Figure 6:
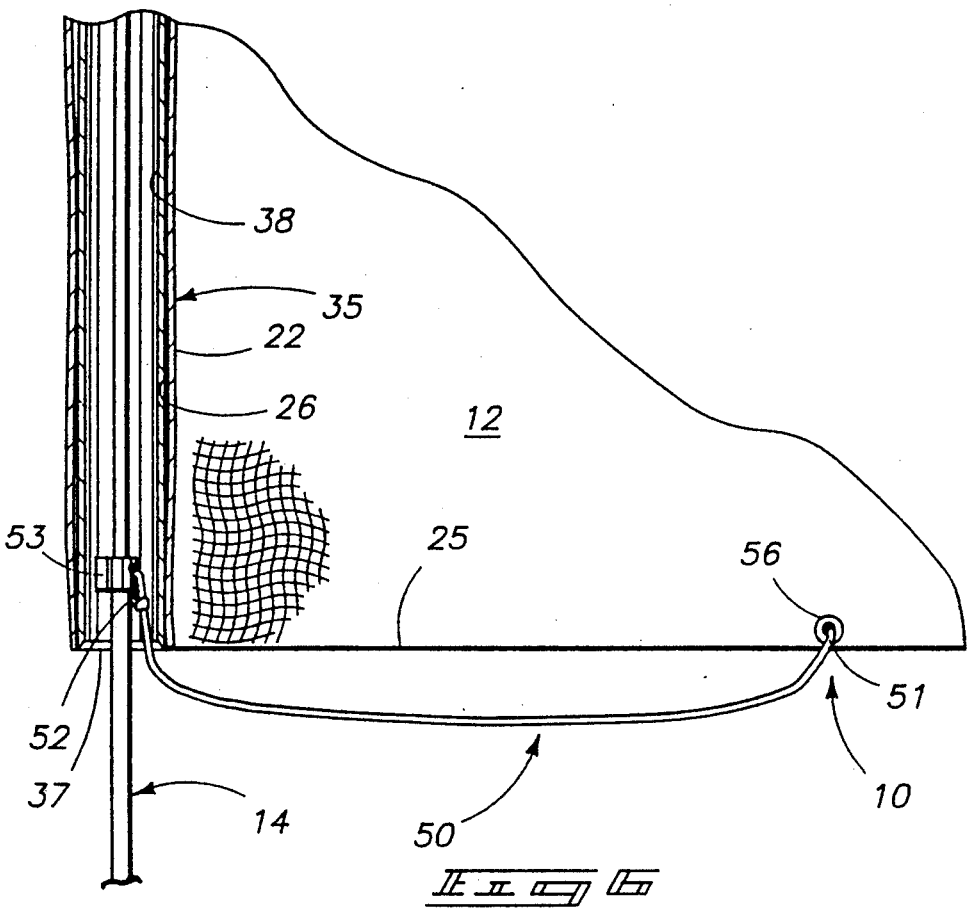
FIG. 6 is an enlarged fragmented view of a portion of the present flag mounted to a retractable support.
Figure 7:
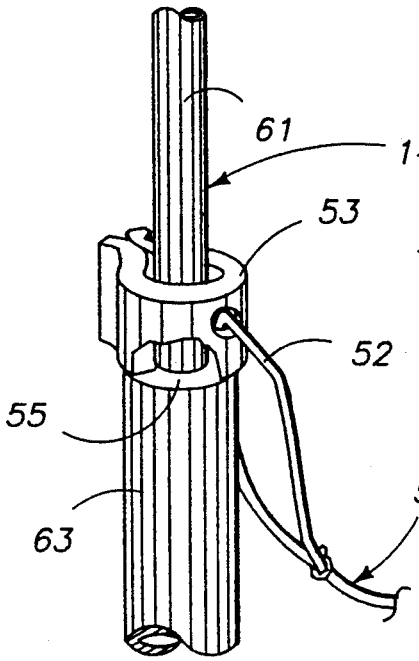
FIG. 7 is an enlarged detailed view of a clip and a portion of a lanyard connecting the clip and flag.

The lanyard 50 extends from the first end 51 to a second end 52 that is attached to a spring clip 53. The length of the lanyard from the first end 51 to the second end 52 and spring clip 53 is slightly greater than the distance between the leading edge 22 and the point of attachment 56 on flag (FIG. 6). The lanyard is advantangeously formed of low visibility line such as the plastic "monofilament" line in popular use by fisherman.

Figure 4:
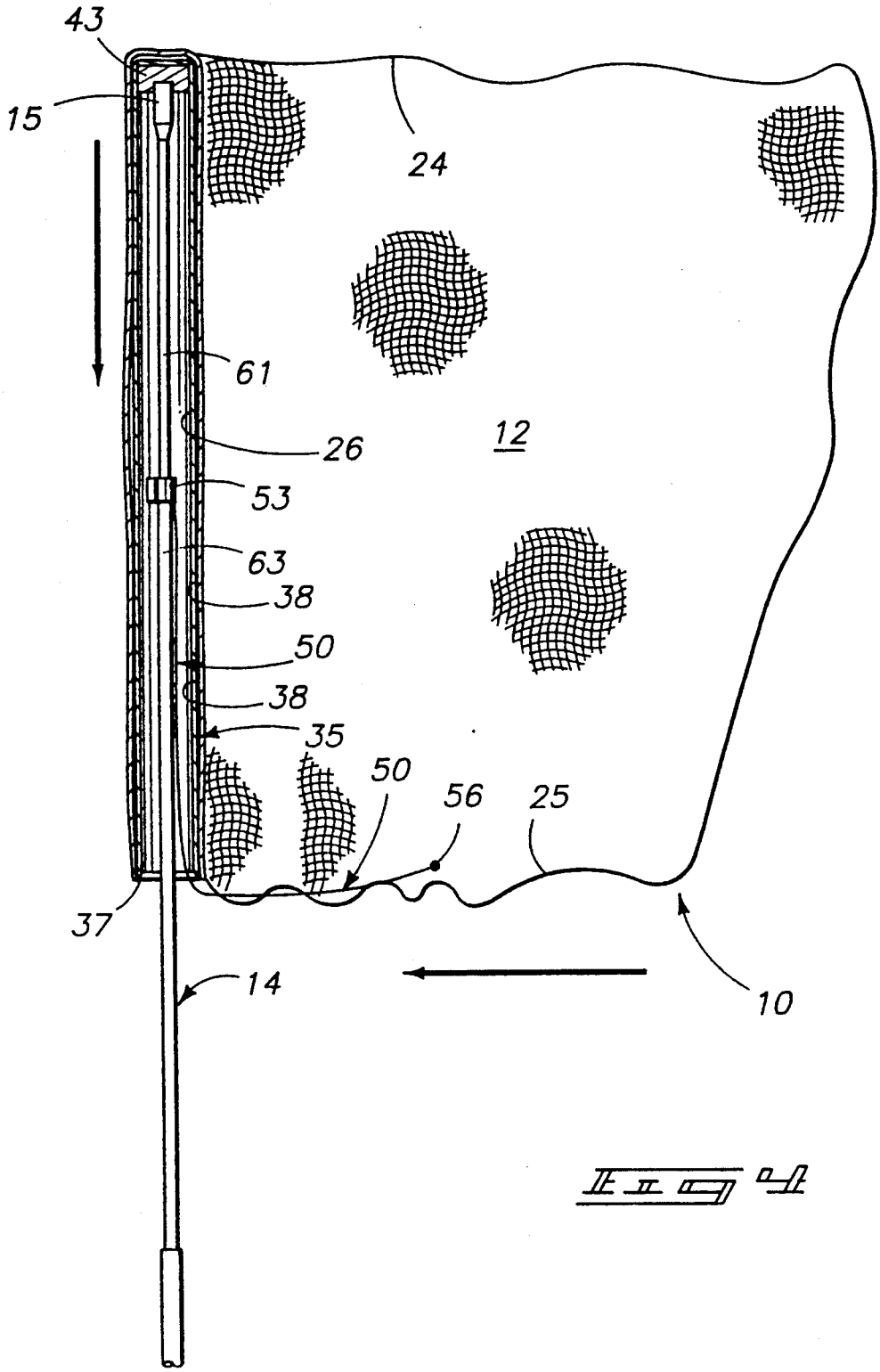
FIG. 4 is a view similar to FIG. 3 only showing the standard partially retracted and the flag partially furled.

The spring clip 53 (FIG. 7) includes flared clip ends, spaced apart from one another to releasably receive and snap over a top standard section 61 of several telescoping sections 63, 64, etc. When in position on the standard top section 61, the clip 53 rests against the top shoulder 55 of an adjacent standard section 63. Clip 53 is slidable from the shoulder upwardly along the top standard section 61 length to the top standard end 15 (FIGS. 4, 5).

The clip 53 and attached lanyard 50 will move axially within the connector member 35, responsive to retraction and extension of the standard 14. As the standard is retracted, clip 53 slides over the retracting top section 61 toward the top end 36 of the connector member 35. As this happens, the clip 53 pulls lanyard 50 into the connector (FIG. 4). The flag bottom edge 25 is likewise pulled toward the connector member 35.

It is pointed out that the flag configuration described above may be useful in mounting arrangements other than those described herein. For example, the present flag body, the connector member 35, lanyard 50, and clip 53 may be substituted for the flag shown in my earlier filed application cited above.

In the present preferred assembly 11, in which the flag 10 is included with the mounting components, the telescoping sections 60 are preferably formed in substantially equal lengths of approximately 12 inches. It is preferred that at least five of the sections be provided such that the total extended length of the sections be approximately four to five feet.

It is advantageous that all of the telescoping sections of the standard 14 be constructed of a rigid corrosion resistant metal such as stainless steel. Such material strengthens the standard and facilitates further use, if desired, as an antenna for a communications device such as a standard AM-FM radio 68 (FIG. 1) by way of a conventional antenna connector 67.

Further details relating to the telescoping sections of the standard 14 and connection thereof to the antenna connector 67 will not be discussed in further detail. Such components are conventional and well known in the art.

A surface mounting device 70 is provided for mounting the retractable standard 14 and flag body 12 to a support surface 16. The device 70 is specifically provided such that the standard and flag body may be situated in an out-of-sight, fully retracted inoperative position, to the underside 19 (FIG. 1) of the support surface 16.

The surface mounting device 70 advantageously includes an elongated tubular sleeve 75 (FIGS. 1, 5) The sleeve 75 is sufficiently long to receive the fully retracted standard 14 and the flag body 12 below the support surface 16. The sleeve extends between an open top end 76 to a base end 79 mounted to the base end of the standard 14.

A cap 77 is mounted at the top end 76 of the sleeve 75. Cap 77 is provided with a flange 80 slidably mounting the open top sleeve end 76. Adhesive may be used to secure the sleeve 75 in position on the flange 80. An insulator lined opening (not shown) extends through the cap 77 and into the hollow interior of the sleeve 75 to provide passage for the flag body 12 and standard 14.

The cap 77 may include a slidable cover 78 mounted to a base 81 (FIG. 5). The base 81 is mounted to the flange 80. Standard fasteners such as screws (not shown) fasten the base 81 and flange 80 to a deck or other support surface 16. The cover 78 is movably mounted to the base 81 and selectively spans the cap opening and the open top end 76 of the sleeve 75.

The cover 78 is pivotable to a position beside the cap opening and open sleeve top end 76 to enable extension and retraction of the flag body 12 and standard 14. When closed, the cover 78 will visually conceal the flag and standard. It will also prevent water and debris from collecting within the sleeve 75 when the present assembly is stored below the support surface.

The tubular sleeve base 79 mounts the standard 14 and is mechanically secured as by male and female threaded fittings 82 to a right angle adapter or radius "ell" 86, and a power drive 84. The standard is axially secured by the base 79 and by the right angle adapter as shown in FIG. 5. Base 79 is perforated as may be the adapter 86 to facilitate drainage and prevent accumulation of water in the power drive 84.

A useful power drive 84 is identified as model QM1 or QM2, produced by Harada Industries of America, Inc., 1650 West Artesia Boulevard, Gardena, Calif. 90248-3297. Harada is also a supplier of the conventional components for standard 14, antenna connector 67, and other components as discussed herein.

Figure 2:
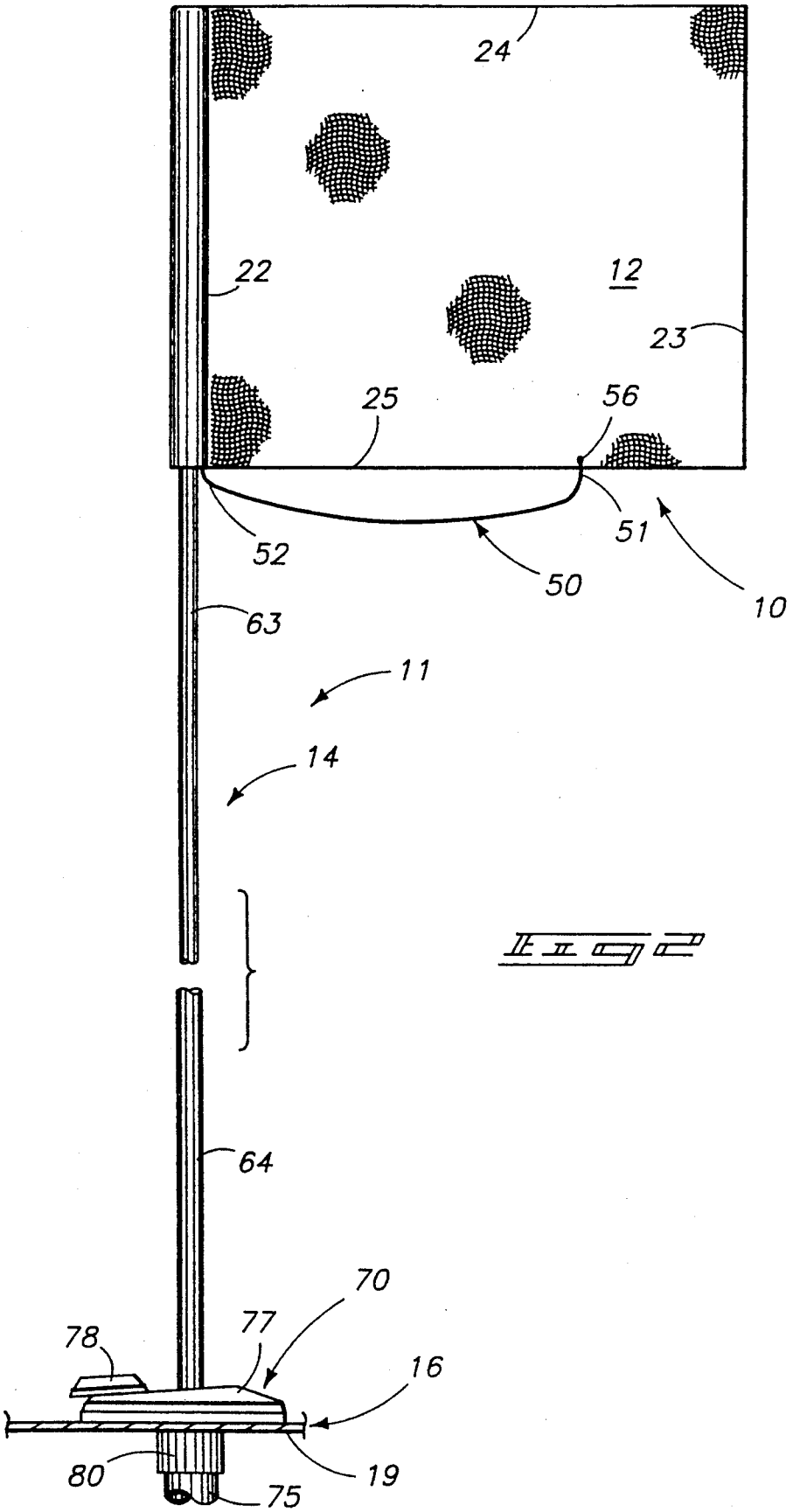
FIG. 2 is an elevation view of the present flag and a retractable standard in an upwardly extended, operative condition.

The power drive 84 is selectively operable to move the standard from the operative position shown in FIG. 2 to the inoperative, shortenend storage position shown in FIG. 5. A flexible cable 85 (FIG. 5) of the power drive 84 is connected to the standard 14 in a conventional manner.

To minimize the overall length of the assembly 11, the power drive is mounted to the sleeve 75 at an angle (approximately 90° to the sleeve). The right angle adapter 86 is used for this purpose.

The adapter 86 is attached to a standard antenna base fitting 87 on the power drive case 88. Adapter 86 includes a guide, preferably in the form of a low friction tube 89 or an inner surface of the adapter 86 to bend the drive cable 85 through the necessary aproximate right angle to the sleeve 75 and standard 14. The tube ends abut the drive case 88 and standard to prevent axial movement of the standard toward the drive case. The adapter 86 may also mount the standard antenna connector 67 to thereby enable connection of the standard 14 to a radio 68.

By so connecting the drive 84 and standard 14, I am able to minimize the overall length of the entire unit, thereby enabling mounting of the unit in vertically confined spaces.

The power drive 84 is connectable to a power source 96 (FIG. 1) which may be a battery or other source of electrical energy. The connection is accomplished by means of an appropriate electrical circuit 97 including a conventional switch 98 for operation to selectively activate the drive. The switching arrangement 98 may also be a conventional unit provided by the above-referenced supplier.

A switch means 90 is provided on the surface mounting device 70 for deactivating the power drive means when the slidable cover 78 is covering the retractable standard. The switch means 90 is operably connected to the cover slide 78 and the electrical circuit 97 to deactivate the power drive means when the cover 78 is positioned over the standard. The switch means 90 thus prevents a user from accidently activating the power drive 84 to elevate the standard 14 when the cover slide 78 is closed. The switch means 90 may be comprised of a conventional limit switch 99 connected within the circuit 97 and mounted with its operator arm operatively engaging the cover 78 to open the circuit 97 when the cover 78 is closed. The switch will close when the cover 78 is opened to permit extension of the standard 14. The closed switch thus activates the circuit 97 and allows operation of the user operated switch 98.

Prior to operation, the present flag assembly 11 is mounted to a support surface, for example the deck of a boat, simply by first drilling a hole through the deck surface. The hole is drilled at a location where there is sufficient clearance beneath the deck underside 19 to facilitate mounting of the tubular sleeve 75.

With the various features described above, positioning the assembly in a boat is a relatively simple matter. This is due to the fact that the overall length of the entire assembly when retracted to the shortened inoperative condition is typically less than applicable vertical dimensions between the deck surface of a recreational boat and its hull.

The flag assembly 11 is secured to the deck surface by the surface mounting device 70. The cap flange 80 and base 81 are positioned over the drilled hole and are attached by means of conventional screws, adhesive, or other appropriate fastening mechanisms. The tubular sleeve 75 is then attached to the flange 80. This may be accomplished by a friction fit between the interfitting sleeve flange sections of the cap and sleeve 75 and by use of an adhesive or conventional fastener. The sleeve may be further secured to the boat by a conventional clap or bracket 100 (FIG. 1) adjustably mounted on the sleeve 75.

The present flag assembly 11 is now mounted to the boat. The remaining connections simply involve standard electrical connections the electrical supply for the boat, and mounting of the user operable switch 98. Further, if provided, the antenna connector 67 may be connected by conventional means to a radio 68 (FIG. 1).

Once installed, operation of the present flag assembly is a simple matter of pivoting the cover 78 and operating the switch 98. The cover may be pivoted to the open position at the beginning of the skiing activity and closed when the activity is finished. During the skiing activity, when a skier releases the tow rope, or falls, the boat operator, or an observer in the towing boat may simply operate the switch 98 to close a circuit 97 to the power drive 84. This results in extension of the standard and elevates the flag body 12 to a highly visible operative position.

The flag body 12 will automatically unfurl from the tubular sleeve 75 as it is elevated away from the confines of the sleeve. Unfurling is assured by the relatively rigid nature of the connector member 35 and the secure attachment of the flag body at the leading edge 22. Also, as the standard 14 extends, the top section 61 progressively lifts the connector member 35 over the length of the adjacent section 63. The lanyard 50 will simultaneously move outwardly of the connector member 35 and allow the flag bottom edge 25 to unfurl.

When the conditions dictate, the switch 98 may again be operated to lower the flag. This is again accomplished by appropriate actuation of the switch 98. The drive unit 84 thus retracts the telescoping sections 60, pulling them downwardly into the tubular sleeve 75.

It is important to note that accumulating telescoping sections are progressively received within the tubular connector 35 as it is drawn downwardly into the tubular sleeve 75. The connector member 35 receives the sections until nearly all of the accumulated standard 14 is contained therein.

Typically the top section 61 is the first to retract into the adjacent section 63 below. As this happens, the spring clip 53 is held in place by the shoulder 55 of the adjacent section 63. The shoulder 55 thus drives the clip 53 (FIG. 4) into the downwardly moving connector member 35. The clip 53 correspondingly pulls the lanyard 50 into the connector member 35. The lanyard 50, being attached at it's first end 51 to the flag body at 56, simultaneously pulls the bottom edge of the flag body 12 inwardly toward the connector member 35. The flag thus gathered at it's bottom edge 25 will not occupy substantially any more axial space within the sleeve than the connector member 35 (see FIG. 5). The bottom edge 25 thus gathered is also prepared for reception through the surface mounting device 70.

As the standard sections retract into the tubular sleeve 75, the flag body 12 is automatically furled about the connector 35, between the external surfaces of the connector and the internal facing surfaces of the tubular sleeve 75.

The flag will consistently furl in this manner for each operation due in part to the flexible nature of the flag body 12, the attachment of the leading edge at the top and bottom ends of the connector 35, and the lanyard assembly. The furled axial height of the flag body is assured by provision of the lanyard arrangement to be the approximate axial height of the flag body (between top edge 24 and bottom edge 25).

The lanyard connection will not allow the diagonal dimension of the flag 10 to become the furled height of the flag within the sleeve 75. This is true because the bottom edge of the flag is drawn up so the contact point 56, in effect, becomes the inward edge of the flag as the lanyard length is pulled into the connector. The diagonal flag dimension thus becomes the diagonal dimension between the lanyard connection point 56 and the top outer flag corner (the junction of trailing edge 23 and top edge 24). This dimension is considerably less than the true diagonal dimension of the unfurled flag body 12. The lanyard connection thus further minimizes the required axial height of the assembly 11.

The tubular sleeve 75 is of sufficient dimension to assure full retraction of the flag body 12, so no portions of the retracted flag will remain above the cap 70.

Should the user wish to change or replace the flag 10, removal is accomplished simply by releasing the fitting 43 and pulling the spring clip 53 from the top standard section 61. The connector member and flag body are thereby easily removed from the standard. A different flag 10 can then be mounted to the standard 14.

The flag body and connector member may also be selectively removed from the standard to permit use of the standard 14 as a communications antenna. Thus, the standard 14 may function in an antenna mode, without the flag 10 which might otherwise falsely indicate the presence of individuals in the water about the boat.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the Doctrine of Equivalents.

We claim:

1. A signal flag for a retractable standard having telescoping standard sections including a top section slidably received in an adjacent section having a shoulder at a top end, the standard sections being retractable to a prescribed retracted length, the signal flag comprising:

a connector member including a rigid tube extending between a top end and a bottom end receivable over a selected length of the retractable standard such that the telescoping standard sections may be selectively retracted at least partially into the connector member between the connector top and bottom ends;

a standard attachment fitting on the connector member for securing the connector member to the top section of the retractable standard;

a flag body formed of a flexible material and including a top edge and a bottom edge extending from the connector member to a free trailing body end;

a lanyard having a first end attached to the flag body between the free trailing end and the connector member, and a second end; and a clip on the second end of the lanyard, loosely receivable over the top section of the retractable standard and slidable along the length thereof within the connector member, for abutment with the top shoulder of the adjacent standard section so that when the standard sections are retracted, the adjacent section top shoulder will engage and hold the clip relative to the retracting top standard section and pull the lanyard into the connector member, gathering the flag body inwardly toward the connector member.

2. The signal flag for a retractable standard having telescoping standard sections as claimed by claim 1, wherein the first end of the lanyard is connected to the bottom edge of the flag body.

3. The signal flag for a retractable standard having telescoping standard sections as claimed by claim 1, wherein the lanyard is connected to the flag body at a point approximately ¾ of the distance between the connector member and the free trailing end of the flag body.

4. The signal flag for a retractable standard having telescoping standard sections, including a top section as claimed by claim 1, wherein the connector member is tubular, with a central bore for loosely receiving the clip and the top section of the telescoping standard sections.

5. The signal flag for a retractable standard having telescoping standard sections, including a top section with a top end as claimed by claim 1, wherein the connector member is tubular, with a central bore for loosely receiving the top section of the telescoping standard sections and wherein the standard attachment fitting is located at the top end of the connector member.

6. The signal flag for a retractable standard having telescoping standard sections, including a top section with a top end as claimed by claim 1, wherein the connector member is tubular, with a central bore for loosely receiving the top section of the telescoping standard sections and wherein the standard attachment fitting is located at the top end of the connector member and includes a receptacle for releasably receiving the top end of the top standard section.

7. The signal flag for a retractable standard having telescoping standard sections as claimed by claim 1, wherein the connector member is tubular to loosely receive a length of the standard and further comprising means for securing the flag body to the top and bottom ends of the connector member.

8. The signal flag for a retractable standard having telescoping standard sections as claimed by claim 1, wherein the connector member is rigid along its length.

9. A self storing signal flag assembly for subsurface mounting to a support, comprising:

a retractable standard having telescoping standard sections extendable to an operative exposed elongated condition and retractable to a shortened storage condition and including a top section extending to a top end and an adjacent section slidably receiving the top section therein, the adjacent section including a top shoulder through which the top section extends;

a tubular connector member including a top end and a bottom end loosely receivable over at least a portion of the top section of the standard to enable at least a portion of the standard to be retracted into the connector member between the top and bottom edges thereof;

a fitting on the connector member for securing the connector member to the retractable standard;

a flag body formed of a flexible material and including a leading edge securable to the connector member, and a free trailing end;

a lanyard having a first end attached to the flag body between the free trailing end and the leading edge, and a second end;

a clip on the second end of the lanyard, loosely receivable over the top section of the retractable standard and slidable along the length thereof within the connector member, for abutment with the top shoulder of the adjacent standard section so that when the standard sections are retracted, the adjacent section top shoulder will engage the clip and pull the lanyard into the connector member, thereby gathering the flag body inwardly toward the connector member; and a surface mounting means for mounting the retractable standard and flag body to a support surface with the flag body standard situated underneath the surface when the standard is retracted to the shortened storage condition thereof.

10. The self storing marine signal flag assembly for subsurface mounting to a support, as claimed by claim 9 further comprising:

a power drive means connected to the retractable standard for extending and retracting the retractable standard.

11. The self storing signal flag assembly for subsurface mounting to a support as claimed by claim 9 further comprising:

a power drive means connected to the retractable standard for extending and retracting the retractable standard.

an angle adapter mounting the standard to the drive means at an approximate right angle thereto.

12. The self storage signal flag assembly for subsurface mounting to a support, as claimed by claim 9 wherein the power drive means is oriented at approximately a right angle to the retractable standard.

13. The self storing signal flag assembly for subsurface mounting to a support as claimed by claim 9 wherein the connector member includes a central bore that is elongated to receive substantially the full prescribed retracted length of the standard when in the shortened storage condition thereof and of a diameter to freely slidably receive the clip and a portion of the lanyard therein.

14. The self storing signal flag assembly as claimed by claim 9 wherein the fitting is positioned at the top end of the connector member to releasably secure the connector member to the top end of the standard top section.

15. The self storing signal flag assembly for subsurface mounting to a support as claimed by claim 9 wherein the lanyard includes a length dimension approximately equal to a length dimension of the connector member from the top to the bottom end thereof.

16. The self storing signal flag assembly for subsurface mounting to a support as claimed by claim 9 further comprising a power drive means for extending and retracting the retractable standard, the power drive means including a flexible cable connected to the retractable standard and an angle adapter with a guide for bending the cable through an approximate right angle between the power drive and the retractable standard.

17. The self storing marine signal flag assembly for subsurface mounting to a support, as claimed by claim 9 further comprising:

a power drive means connected to the retractable standard for extending and retracting the retractable standard;

the surface mounting means including a cap for selectively covering the retractable standard when in the retracted storage condition; and switch means on the surface mounting means for deactivating the power drive means when the cap is covering the retractable standard.

18. The self storage signal flag assembly as claimed by claim 9 wherein the standard is an antenna and includes a connector for electrical connection to a communication device.

* * * * *